US006580341B2

(12) United States Patent
Henningsson et al.

(10) Patent No.: US 6,580,341 B2
(45) Date of Patent: Jun. 17, 2003

(54) APPARATUS FOR IMPROVING COMMUNICATION SYSTEMS

(75) Inventors: Uno Henningsson, Haninge (SE); Matti Liikamaa, Bromma (SE); Bertil Ericsson, Upplands Vasby (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/796,358

(22) Filed: Mar. 2, 2001

(65) Prior Publication Data

US 2002/0053956 A1 May 9, 2002

(30) Foreign Application Priority Data

Mar. 3, 2000 (SE) ..... 0000715

(51) Int. Cl.[7] ..... H01P 1/20; H01P 1/04
(52) U.S. Cl. ..... 333/202; 333/203; 333/260
(58) Field of Search ..... 333/134, 202, 333/203, 230, 260

(56) References Cited

U.S. PATENT DOCUMENTS 4,824,399 A * 4/1989 Bogar et al. ..... 29/747
4,957,456 A * 9/1990 Olson et al. ..... 439/578
5,001,443 A 3/1991 Martin, III ..... 333/26
5,304,962 A * 4/1994 Bobadilla et al. ..... 29/600
5,329,262 A * 7/1994 Fisher ..... 333/260
5,446,729 A * 8/1995 Jachowski ..... 333/1
5,543,758 A * 8/1996 Wey ..... 333/202
5,576,675 A * 11/1996 Oldfield ..... 333/260
5,836,776 A * 11/1998 Koch ..... 200/51.1
5,980,326 A * 11/1999 Weidner et al. ..... 439/426

* cited by examiner

*Primary Examiner*—Seungsook Ham

(57) ABSTRACT

The present invention relates to a single-piece center conductor (15) for a LC-filter, and a LC-filter comprising at least one such center conductor. The center conductor comprises a first end section (20) with axially form confining fixing means and a second end section with means for direct connection to connecting means of a connector. A general object of the present invention is to provide an improved apparatus for connecting a LC-filter with a connector in terms of intermodulation interference, contact area with the LC-filter, accurate fastening to the LC-filter, assembly time, manufacturing, storage costs and logistics costs.

18 Claims, 4 Drawing Sheets

APPARATUS FOR IMPROVING COMMUNICATION SYSTEMS

TECHNICAL FIELD OF THE INVENTION

The present invention generally relates to a centre conductor for connecting an LC-filter with a connector, for example a coaxial connector fixed on a coaxial cable. The invention also relates to an LC-filter comprising at least one such centre conductor.

DESCRIPTION OF RELATED ART

In LC-filter networks for filtering selected frequencies, for example when LC-filters are used in communication systems, for instance in radio base stations, it is a problem that mechanically joined electrical couplings between two components are likely to create a P-N-junction, thereby creating intermodulation interference problems Therefore, it is desirable to create a network with as few couplings as possible, especially friction couplings and brazed couplings, to reduce the intermodulation interference.

Therefore, it is desirable to invent an apparatus with as few couplings and parts as possible for connecting, for example, a standard coaxial cable to an LC-filter. However, so far such an apparatus still involves brazed couplings and parts that create undesired intermodulation interference.

U.S. Pat. No. 5,001,443-A discloses coaxial units for conducting microwaves to and from amplifying apparatus with splitter and combiner cavities. A coaxial coupling unit is fixed to a first plate member and has a tubular outer conductor and an inner conductor that are insulated from each other by a sleeve. The inner conductor has a lower pin part with a free end that has a frusto-conical exterior shape with slots, which extend upwards. The slots divide the pin into axially extending fingers, which are deflectable radially inwards. This enables the pin to be pressed into a hole in a second plate member. The inner conductor thus creates a friction coupling with the second plate member. The upper end of the inner conductor is shaped as a stub The embodiment of the inner conductor disclosed in U.S. Pat. No. 5,001,443-A has features that are undesirable if the coaxial unit for some reason would be used in an LC-filter. A friction coupling of the described type demands small limits of tolerance during manufacturing of both the coupling unit and the hole in a receiving member of the LC-filter, since it is a friction coupling exclusively by press fit It is also very difficult to achieve a predetermined desired coupling force between the inner conductor and the receiving member. Furthermore, if the inner conductor is fixed to the coaxial unit, the conductor and the hole in the sleeve would require very small limits of tolerance for a secure press fit, or an extra arrangement, for keeping the inner conductor fixed in the coaxial unit. Of course this increases the manufacturing costs of the coaxial unit. If the inner conductor is not a fixed part of the coaxial unit, a detachment of a to the coaxial unit before connected coaxial cable may withdraw the inner conductor from the hole or decrease the contact surface between the hole and the inner connector. This reduces the reliability of proper contact when a coaxial cable is to be attached again, or creates a renewed assembly time to reinstall the coaxial unit in a proper way. Also, since the upper part of the inner conductor is shaped as a stub, the inner conductor does not fit a standard connector that is fixed to a coaxial cable and has a pin member projecting out from the connector. This kind of connector is common for LC-filters, such as cavity filters.

SUMMARY

It is therefore a general object of the present invention to solve or reduce the above mentioned problems and disadvantages by providing an improved apparatus for connecting an LC-filter with a connector, in terms of intermodulation interference, contact area with the LC-filter, accurate fastening to the LC-filter, assembly time, manufacturing, storage costs and logistics costs.

It is also a general object of the present invention to provide an improved LC-filter in such a way that the LC-filter enables an improved connection with a connector, such as a coaxial connector fixed to a coaxial cable, by using the improved centre conductor and modifying the LC-filter for an improved fit with the centre conductor.

The present invention therefore provides a single-piece centre conductor for an LC-filter. Thereby, the centre conductor does not involve two or more parts that have to be connected, e.g. by brazing. This reduces intermodulation interference problems and saves assembly time. Furthermore, it saves storage costs as well as logistics costs since fewer parts have to be manufactured, registered and stored.

The centre conductor comprises a first end section with axially form confining fixing means, and a second end section with means for direct connection to connecting means of a connector, such as a coaxial connector fixed to a coaxial cable. With axially form confining fixing means are meant: fixing means that due to its form see to that the centre conductor substantially is not able to be axially removed in relation to the LC-filter when the centre conductor is mounted to the LC-filter and subjected to a tractive force. Thus when the first end section is mounted to the LC-filter, for example by engaging a partially threaded bore in the LC-filter, the fixing means substantially prevent axial movement of the centre conductor relative to the LC-filter when the centre conductor is subjected to a force substantially parallel with a longitudinal axis of the centre conductor. With that a problem with possible disconnection between the first end section and the LC-filter is avoided in case of disconnection of the coaxial cable from the LC-filter. The axially form confining fixing means also are allowed to have larger limits of tolerance than such a press fit as the one mentioned before in the discussion about U.S. Pat. No. 5,001,443-A. This makes the centre conductor easier to manufacture than if friction means were to be used.

The means at the second end section preferably comprise a cavity for engaging the connecting means of the connector, where the connecting means is a pin member. This enables the centre conductor to be directly connected to a pin member of a standard coaxial connector.

Suitably, the cavity is surrounded by at least two tongues, which are resiliently deflectable outwards from, and equiangularly distributed about, the longitudinal axis of the centre conductor. This provides easy and fast attachment and unattachment of the pin member to the centre conductor, as well as a press fit that secures a good contact between the centre conductor and the pin member.

In order to improve the assembly time and the convenience for the installer, the centre conductor comprises at least one tool receiving means for engaging a tool during mounting of the centre conductor to the LC-filter. The tool receiving means may comprise a cross section with a regular polygonal shape, such as a hexagon shape, which enables engagement with an ordinary socket wrench. Alternatively or in addition to the above mentioned polygonal shape, the tool receiving means may comprise at least one aperture, for example a through-hole or an exterior slot, for engagement with pins, clutches or other kinds of assembly tools.

Furthermore, the centre conductor preferably comprises a middle section with a larger cross sectional area than the first and second end sections. Suitably the middle section comprises a substantially flat ring-shaped surface, which is perpendicular to the longitudinal axis of the centre conductor and has a normal pointing outwards towards the first end section. This enables the ring-shaped surface to contact an opposite flat surface around the receiving bore of the LC-filter. Thus a larger contact area between the LC-filter and the centre conductor is created.

The form closing fixing means are preferably threads. This enables the centre conductor to be fixed in the bore of the LC-filter with a predetermined force, which easily is determined since sufficient torque meters for screw joints are widely used in assembly workshops. The threads also enables a type of cold welding between the ring shaped surface and the opposite flat surface of the LC-filter as the ring shaped surface is screwed into contact with the opposite flat surface. The type of cold welding further improves the contact between the centre conductor and the LC-filter.

The present invention further provides an LC-filter, which for instance is used in a radio base station, with at least one such a centre conductor as described above. Preferably the LC-filter is a cavity filter with an input resonator, comprising a bore having an outer mouth and wall, which comprises threads and engages the centre conductor, and a substantially flat surface that surrounds the outer mouth and is substantially perpendicular to a longitudinal axis of the bore. The LC-filter may also comprise an output resonator engaging a second centre conductor of the above described type.

BRIEF DESCRIPTION OF THE DRAWINGS

The objects, advantages and effects as well as features of the present invention will be more readily understood from the following detailed description of a preferred embodiment, as well as other embodiments, when read together with the accompanying drawings in which.

DETAILED DESCRIPTION OF EMBODIMENTS

Figure 1:
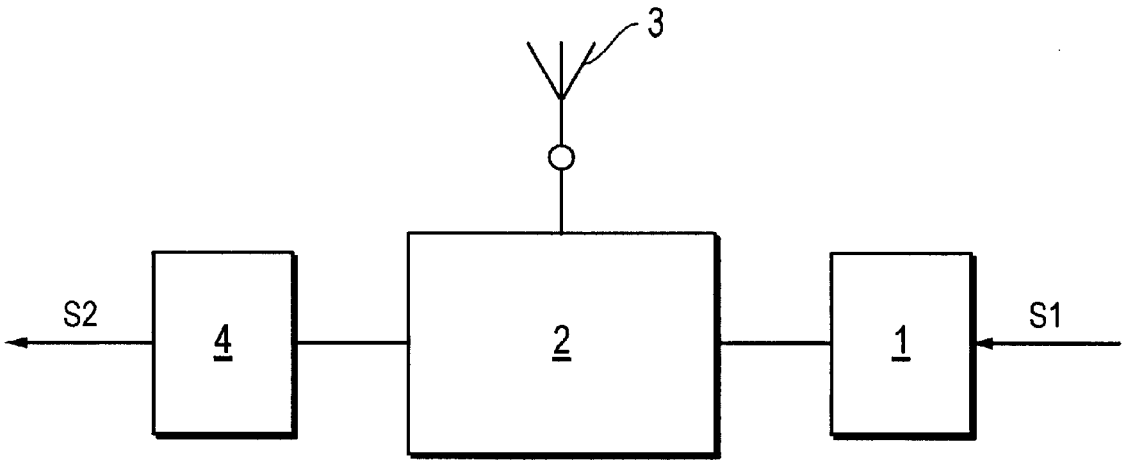
FIG. 1 shows a schematic block diagram of a radio base station.

While the invention covers various modifications and alternative constructions, a preferred embodiment of the invention is shown in the drawings and will hereinafter be described in detail. It is to be understood, however, that the specific description and drawings are not intended to limit the invention to the specific forms disclosed. On the contrary, it is intended that the scope of the claimed invention include all modifications and alternative constructions thereof falling within the spirit and scope of the invention as expressed in the appended claims to the fall range of their equivalents.

FIG. 1 shows a schematic block diagram of a radio base station used in a mobile telephone network. When an input signal S1 is sent to the radio base station, a corresponding signal is transmitted out from the radio base station over a transmitter 1, a filter apparatus 2 and an antenna 3. When the antenna 3 receives a signal from the air, the radio base station provides an output signal S2 over the filter apparatus 2 and a receiver 4. The filter apparatus 2 typically includes LC-filters operating as a band-pass filter circuit.

Figure 2:
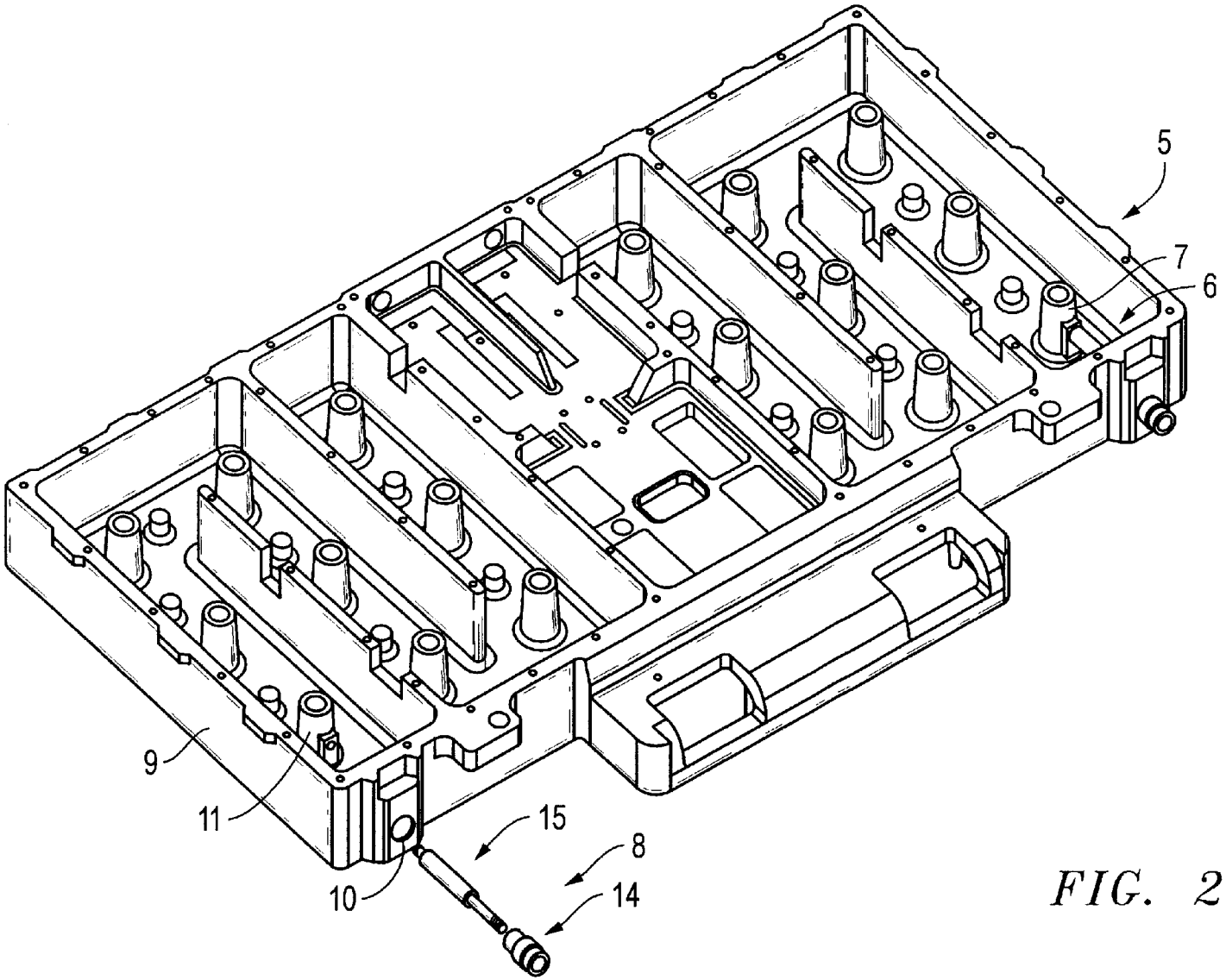
FIG. 2 shows a perspective view of an LC-filter in the form of a cavity filter, where one of the walls of the cavity filter is removed.

FIG. 2 shows an LC-filter in the form of a cavity filter 5, for instance for the filter apparatus 2 in the radio base station, where an upper wall is removed to show the interior of the cavity filter 5. The cavity filter has an output apparatus 6 according to the invention, here shown mounted to an output resonator 7, for connecting the cavity filter 5 to a coaxial cable (not shown). An apparatus, similar to the output apparatus 6, for connecting an input coaxial cable (schematically shown in FIG. 3) to the cavity filter 5 is generally designated as 8 and will be used to further explain the preferred embodiment. The cavity filter 5 comprises a grounded chassis 9 with a bore 10, which preferably is threaded, but may be substantially smooth. In mounted position, the apparatus 8 is connected to the cavity filter 5 through the chassis 9 and an input resonator 11.

Figure 3:
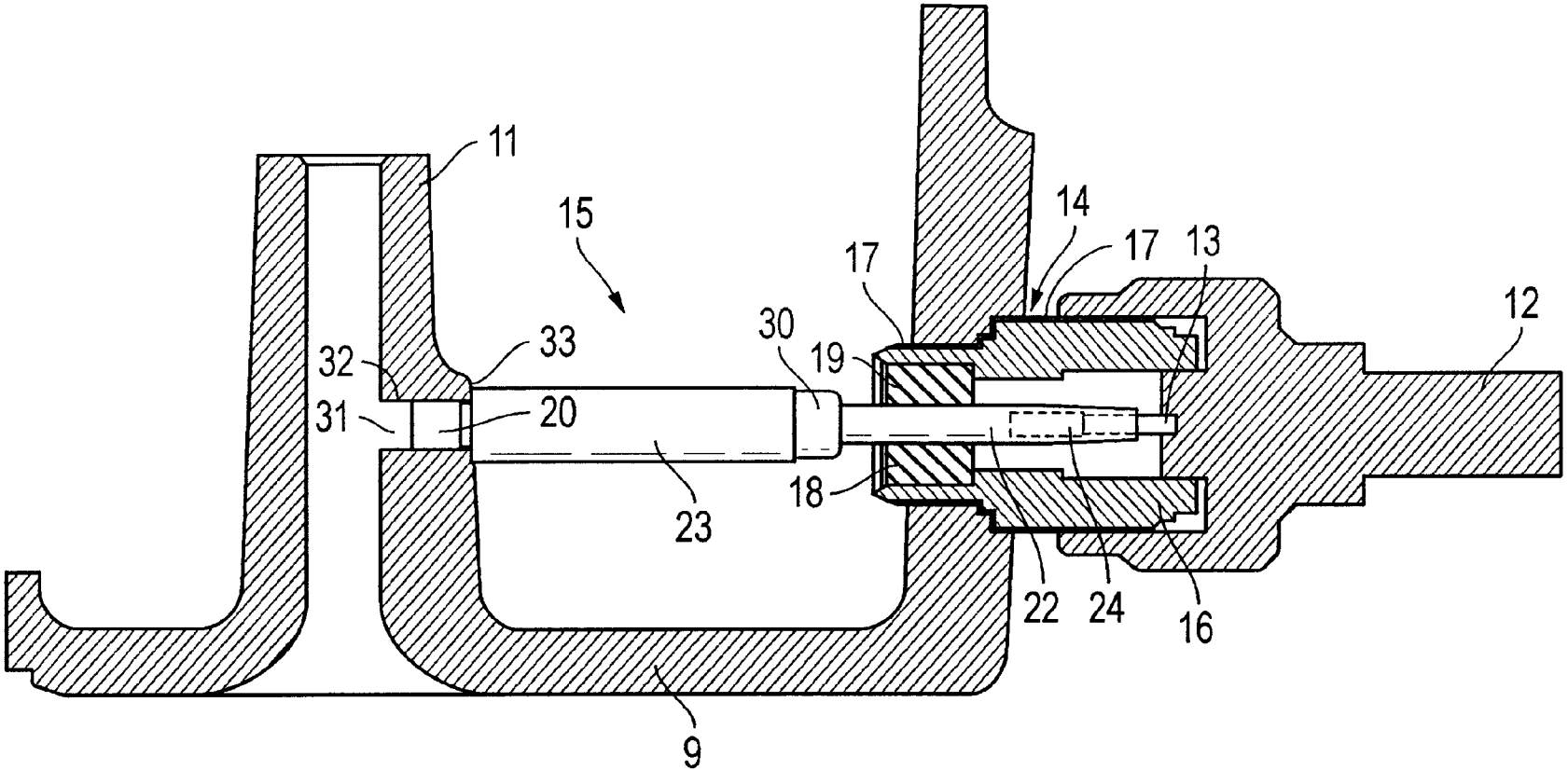
FIG. 3 shows a partial cross sectional view of a part of the cavity filter according to a preferred embodiment of the invention.

FIG. 3 is an enlarged partial cross sectional view of a part of the cavity filter 5 shown in FIG. 2, where the apparatus 8 for connecting a coaxial cable 12 to the cavity filter 5 is shown in more detail. The coaxial cable 12 with an associated connector is only schematically drawn since it is not a part of the invention. However, it is to be understood that the associated connector may be any suitable coaxial connector with an inner conductor and an outer conductor for engaging the apparatus 8, wherein the inner conductor comprises connecting means, for example a pin member 13 projecting out from the connector, for engagement with the apparatus 8.

The apparatus 8 generally comprises a connector unit 14 and a centre conductor 15 (see FIG. 2). The connector unit 14 comprises a tubular conductor shell 16 with outer fixing means in the form of screw threaded portions 17, of which at least one is near each end of the connector unit 14, for fixing the connector unit 14 to the chassis 9 of the cavity filter 5 and to ensure the connection to the coaxial cable 12. The shell 16 surrounds a coaxial sleeve 18 of dielectric material. Preferably, the sleeve 18 is mainly positioned near the end of the connector unit 14 that is inserted into the cavity filter 5 (the left part of the connector unit 14 in FIG. 3) and extends towards the centre of the connector unit 14 along the longitudinal axis of the connector unit 14. The sleeve 18 has a circular through-hole 19 concentric with the longitudinal axis of the connector unit 14 in order to allow insertion of the centre conductor 15 into the connector unit 14.

Figure 5:
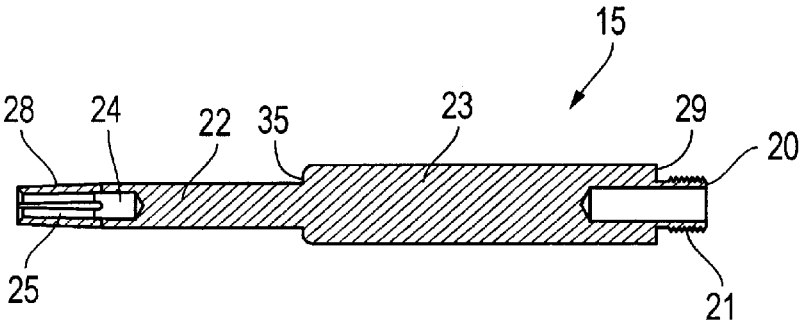
FIG. 5 shows a cross sectional view of the preferred centre conductor.

As especially seen in FIG. 5, the centre conductor 15 is fabricated from one piece of a conducting material that allows certain flexibility for a reason that will be explained later. All the parts of the centre conductor 15 are thus integrated with each other. Preferably the material is a tin-bronze alloy or beryllium-copper alloy. The centre conductor 15 comprises a cylindrical first end section 20 with external axially form confining fixing means in the form of screw threads 21, a second end section in the form of a pin section 22, and a middle section 23 with a larger cross sectional area than both of the end sections 20, 22.

Figure 6:
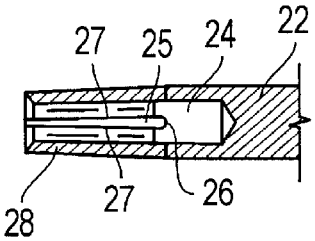
FIG. 6 shows an enlarged view of one of the ends of the preferred centre conductor.

As best seen in FIG. 6, the pin section 22 has means for engaging the connecting means of the inner conductor of the coaxial cable 12, in the form of a cavity 24, for instance a bore, which substantially opens out at the free end of the pin section 22 and is coaxial with the longitudinal axis of the centre conductor 15. At least a part of the portion of the pin section 22 that surrounds the cavity 24 has a frusto-conical exterior shape and at least two, preferably four, slots 25. These slots 25 are substantially equiangularly distributed about, and extend substantially parallel with, the longitudinal axis of the centre conductor 11. Furthermore, the slots 25 are substantially shaped as isosceles triangles with a base side 26 substantially perpendicular to the longitudinal axis of the centre conductor 11 and two sides 27 of equal length extending outwards to the free end of the pin section 22, hereby creating equiangularly distributed tongues 28 between the slots 25. The tongues 28 are resiliently deflectable outwards in order to ensure a manually detachable press fit around the pin member 13 of the connector belonging to the coaxial cable 12.

Figure 4:
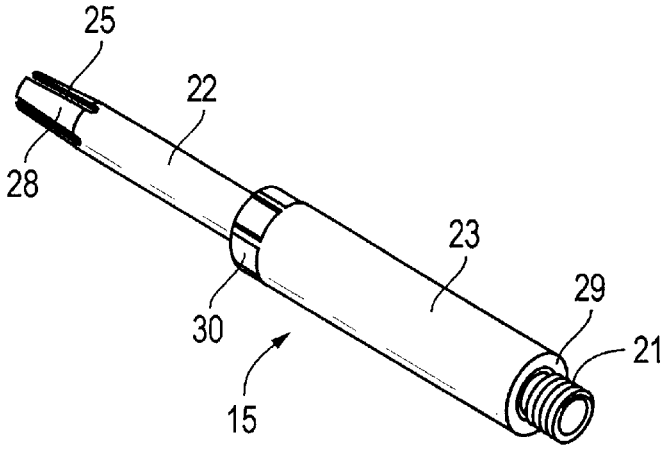
FIG. 4 shows a perspective view of a preferred centre conductor.

The middle section 23 is preferably cylindrical with a flat ring-shaped surface 29, which is substantially perpendicular to the longitudinal axis of the centre conductor 15 and has a normal pointing out from the ring-shaped surface 29 in the direction towards the first end section 20. The middle section 23 also comprises tool receiving means 30 for engagement with a tool during mounting of the centre conductor 15 to the input resonator 11 in a way described later. In FIGS. 3 and 4, the tool receiving means 30 comprises flat surfaces equiangularly distributed about the longitudinal axis of the centre conductor 15 so as to create a cross section with a substantially regular polygonal shape, e.g. a regular hexagonal shape, for engagement with a tool, such as a socket wrench. The tool receiving means 30 is preferably positioned at the end of the middle section 23 adjacent the pin section 22, but may be positioned al some other place on the centre conductor 15.

The input resonator 11 has a bore 31 (see FIG. 3) with a wall, which preferably comprises threads 32, corresponding to the first end section 20 of the centre conductor 15. The input resonator 11 also comprises a substantially flat surface 33 surrounding an outer mouth of the bore 31. The flat surface 33 is perpendicular to the longitudinal axis of the bore 31.

The mounting of the preferred embodiment of the apparatus 8 in the cavity filter will now be described. First, the centre conductor 15 is fastened to the input resonator 11 by screwing the first end section 20 with its screw threads 21 into the bore 31. This is suitably done with the help from a socket wrench that mate with the regular polygonal shape of the tool receiving means 30 and together with the centre conductor 15 is inserted through the bore 10 of the cavity filter 5. The threaded joint between the centre conductor 15 and the input resonator 11 easily allows the installer to tighten the joint to a predetermined desired torque level. The flat ring-shaped surface 29 of the centre conductor 15 contacts the flat surface 33 of the input resonator 11 to provide an even more fixed contact and a larger contact area between them. Also, when the flat ring-shaped surface 29 is in contact with the flat surface 33 of the input resonator 11 and is turned further towards the flat surface 33, a type of cold welding between the two surfaces 29 and 33 is created, which here is advantageous and further improves the contact and stability between the centre conductor 15 and the input resonator 11. In addition, the two surfaces 29 and 33 may be polished before the mounting in order to give an even better contact between them.

When the centre conductor 15 is fixed to the cavity filter 5, the connector unit 14 is easily pushed on to the pin section 22, and introduced in the bore 10 of the cavity filter 5. This is done by inserting the free end of the pin section 22 in the through-hole 19 of the sleeve 18, using one of the screw threaded portions 17 on the shell 16 to mate with the corresponding threads in the bore 10, and then screw a part of the connector unit 14 into the bore 10 of the cavity filter 5. The connector of the coaxial cable 12 is fastened to the apparatus 8, e.g. by screwing and/or pressing, so that the outer conductor of the coaxial cable 12 contacts the shell 16 and thus is connected to the grounded chassis 9, and that the pin member 13 is inserted into the cavity 24 so as to connect to the input resonator 11. The mouth of the cavity 24 has a smaller cross sectional area than the cross sectional area of the pin member 13. When the pin member 13 is pushed into the cavity 24, the resiliency of the material of the centre conductor 15 allows the pin member 13 to press the tongues 28 radially outwards. Hence a proper press fit between the centre conductor 15 and pin member 13 is obtained.

Having described the preferred embodiment of the invention, alternative embodiments within the scope of the present invention will now be described as examples only.

The first end section 20 of the centre conductor 15 may comprise other axially form confining fixing means than the screw threads 21, as long as the fixing means in a mounted position in an LC-filter substantially prevent axial movement of the centre conductor 15 relative to the LC-filter when the centre conductor 15 is subjected to a force substantially parallel with the longitudinal axis of the centre conductor 15. Such alternatives include bayonet couplings, which may require slots in the bore 31 of the input resonator 11 or in the first end section 20 for engaging corresponding locking pins. Other alternatives are clutches integrated at the first end section 20. In a mounted position, these clutches may be L-shaped with a longitudinal portion, which is parallel with the longitudinal axis of the centre conductor 15 and is in contact with the walls of the bore 31, and a transverse portion, which is substantially perpendicular to the longitudinal portion. These transverse portions of the clutches abut against a surface surrounding an inner mouth of the bore 31. This prevents undesired withdrawal of the centre conductor 15 from the input resonator 11 and provides a larger contact surface between the centre conductor 15 and the input resonator 1. Together with the flat ring-shaped surface 29, these clutches axially fix the centre conductor 15 to the input resonator 11.

The cross sectional area of the middle section 23 may have substantially the same cross sectional area, as well as cross sectional shape, as the first end section 20 and the pin section 22. This means that the centre conductor 15 is fabricated without the frusto-conical exterior shape at the free end of the pin section 22. Although preferred, the ring-shaped surface 29 does not necessarily have to be perpendicular to the longitudinal axis of the centre conductor 15, but may have any angle to the longitudinal axis of the centre conductor 15, as well as a curved shape.

Figure 7:
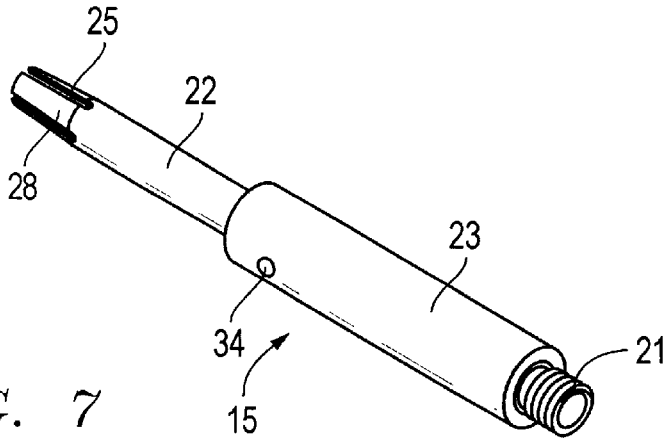
FIG. 7 shows a perspective view of an embodiment of the centre conductor similar to the one in FIG. 4, but having another embodiment of a tool receiving means.

Example of an alternative embodiment of the tool receiving means 30 is at least one aperture in the centre conductor 15, for example a through-hole or an exterior slot of any suitable shape for mating with corresponding means, such as pins or clutches, of an assembly tool. An aperture 34 is illustrated in FIG. 7, where the mouth of the aperture 34 is positioned at the envelope surface of the middle section, but the mouth may also be positioned at a second ring shaped surface 35, which has a normal pointing out from the surface 35 in the direction of the pin section 22 (see FIG. 5).

It is also within the scope of the invention to use a flange with a tubular bearing collar of any suitable material to be mounted around an outer bore, corresponding to the bore 10, of an LC-filter to support the connector unit 14. The bearing collar may be inserted in the bore 10 and/or may project outwards from the LC-filter. Any suitable type of fastener may fix the flange to the LC-filter.

It is also to be understood that the connector unit 14 and the centre conductor 15 may be attached to each other in any suitable way before the installation in an LC-filter.

What is claimed is:

1. A single piece centre conductor for connecting an LC-filter with a connector, comprising:

a first end section with axially form confining fixing means for directly connecting the single piece centre conductor to an LC-filter; and a second end section with means for direct connection to connecting means of a connector.

2. A single piece centre conductor according to claim 1, wherein said means at said second end section comprise a cavity for engaging said connecting means of said connector, said connecting means being a pin member.

3. A single piece centre conductor according to claim 2, wherein said cavity is surrounded by at least two tongues, which are resiliently deflectable outwards from, and equiangularly distributed about, a longitudinal axis of said centre conductor.

4. A single piece centre conductor according to claim 1, comprising at least one tool receiving means for engaging a tool during mounting of said centre conductor to said LC-filter.

5. A single piece centre conductor according to claim 4, wherein said tool receiving means comprises a cross section with a regular polygonal shape.

6. A single piece centre conductor according to claim 4, wherein said tool receiving means comprises at least one aperture.

7. A single piece centre conductor according to claim 4, comprising a middle section with a larger cross sectional area than said first and second end sections regarding a longitudinal axis of the centre conductor.

8. A single piece centre conductor according to claim 7, wherein said middle section comprises a substantially flat ring-shaped surface, which is substantially perpendicular to said longitudinal axis of said centre conductor and has a normal pointing outwards towards said first end section.

9. A single piece centre conductor according to claim 7, wherein said fixing means are threads.

10. An LC-filter comprising at least one centre conductor according to claim 1.

11. An LC-filter according to claim 10, where said LC-filter is a cavity filter with an input resonator.

12. An LC-filter according to claim 11, where said input resonator comprises a bore having an outer mouth and wall, which engages said centre conductor.

13. An LC-filter according to claim 12, where said input resonator comprises a substantially flat surface, which surrounds said outer mouth of said bore and is substantially perpendicular to a longitudinal axis of said bore.

14. An LC-filter according to claim 12, where said wall of said bore comprises threads.

15. An LC-filter according to claim 11, comprising an output resonator engaging a second centre conductor according to claim 1.

16. An LC-filter according to claim 10, wherein said LC-filter is adapted to be used in a radio base station.

17. A single piece centre conductor according to claim 5, wherein the polygonal shape comprises a hexagonal shape.

18. A single piece centre conductor according to claim 6, wherein said at least one aperture comprises a through-hole or an exterior slot.

* * * * *